US007135449B2

(12) United States Patent
Li et al.

(10) Patent No.: US 7,135,449 B2
(45) Date of Patent: Nov. 14, 2006

(54) COMPOSITION FOR REMOVAL OF ODORS AND CONTAMINANTS FROM TEXTILES AND METHOD

(75) Inventors: Shulong Li, Spartanburg, SC (US); Richard A. Mayernik, Mauldin, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/935,032

(22) Filed: Sep. 7, 2004

(65) Prior Publication Data

US 2005/0187124 A1 Aug. 25, 2005

Related U.S. Application Data

(63) Continuation-in-part of application No. 10/783,071, filed on Feb. 20, 2004, now abandoned.

(51) Int. Cl.
*C11D 3/48* (2006.01)
*C11D 3/32* (2006.01)

(52) U.S. Cl. ..... 510/278; 510/276; 510/319; 510/345; 510/361; 510/372; 510/375; 510/382; 510/384; 510/390; 510/444; 510/477; 510/501

(58) Field of Classification Search ..... 510/276, 510/278, 319, 345, 361, 372, 375, 382, 384, 510/390, 444, 477, 501
See application file for complete search history.

(56) References Cited

U.S. PATENT DOCUMENTS

| | | | | |
|---|---|---|---|---|
| 3,901,727 | A | 8/1975 | Loudas | 134/4 |
| 4,013,594 | A * | 3/1977 | Froehlich et al. | 510/278 |
| 4,061,810 | A | 12/1977 | Minhas et al. | 428/85 |
| 4,194,993 | A * | 3/1980 | Deal, III | 510/278 |
| 4,244,834 | A | 1/1981 | Schwalley et al. | 252/106 |
| 4,261,849 | A | 4/1981 | Benjaminson | 252/106 |
| 4,272,396 | A | 6/1981 | Fukano et al. | 252/174.12 |
| 4,304,610 | A | 12/1981 | Weisensel | 134/21 |
| 4,336,165 | A | 6/1982 | Weisensel | 252/528 |
| 4,395,347 | A | 7/1983 | McLaughlin et al. | 252/139 |
| 4,434,067 | A | 2/1984 | Malone et al. | 252/88 |
| 4,440,661 | A * | 4/1984 | Takeuchi et al. | 510/438 |
| 4,490,270 | A | 12/1984 | Hackett et al. | 252/106 |
| 4,493,781 | A | 1/1985 | Chapman et al. | 252/88 |
| 4,526,583 | A | 7/1985 | Gioffre | 8/137 |
| 4,552,777 | A | 11/1985 | Dente et al. | 427/393.1 |
| 4,566,985 | A | 1/1986 | Bruno et al. | 252/174.12 |
| 4,581,385 | A | 4/1986 | Smith et al. | 521/111 |
| 4,637,892 | A | 1/1987 | Merryman | 252/139 |
| 4,648,882 | A | 3/1987 | Osberghaus et al. | 8/142 |
| 4,655,952 | A * | 4/1987 | Mesmer et al. | 510/278 |
| 4,753,746 | A * | 6/1988 | Mesmer et al. | 510/278 |
| 4,873,000 | A | 10/1989 | Weller | 252/8.6 |
| 4,894,220 | A * | 1/1990 | Nabi et al. | 424/52 |
| 5,286,400 | A | 2/1994 | Paszek et al. | 252/88 |
| 5,328,766 | A | 7/1994 | Smith | 428/378 |
| 5,395,555 | A | 3/1995 | Colurciello et al. | 252/546 |
| 5,429,684 | A | 7/1995 | Osberghaus et al. | 134/3 |
| 5,610,189 | A | 3/1997 | Whiteley | 514/557 |
| 5,712,240 | A | 1/1998 | Tyerech et al. | 510/424 |
| 5,736,494 | A | 4/1998 | Colurciello et al. | 510/278 |
| 5,783,543 | A * | 7/1998 | Fleckenstein et al. | 510/280 |
| 5,807,587 | A | 9/1998 | Cox et al. | 424/76.6 |
| 5,955,413 | A | 9/1999 | Campagna et al. | 510/278 |
| 6,126,697 | A | 10/2000 | Ebberts | 8/137 |
| 6,287,550 | B1 | 9/2001 | Trinh et al. | 424/76.6 |
| 6,451,065 | B1 | 9/2002 | Trinh et al. | 8/137 |
| 6,641,829 | B1 | 11/2003 | Green et al. | 424/405 |
| 6,660,713 | B1 | 12/2003 | Carter et al. | 510/507 |
| 6,841,527 | B1 | 1/2005 | Mitra et al. | 510/295 |
| 2002/0035756 | A1 | 3/2002 | Pace et al. | 8/115.51 |
| 2002/0177541 | A1 | 11/2002 | Tarara et al. | 510/392 |
| 2003/0070692 | A1 | 4/2003 | Smith et al. | 134/6 |
| 2003/0109399 | A1 | 6/2003 | Todinl et al. | 510/278 |
| 2003/0139310 | A1 | 7/2003 | Smith et al. | 510/278 |
| 2003/0191034 | A1 | 10/2003 | Woo et al. | 510/101 |
| 2003/0220211 | A1 | 11/2003 | Stoddart et al. | 510/101 |
| 2004/0076792 | A1* | 4/2004 | Green et al. | 428/96 |
| 2005/0187123 | A1* | 8/2005 | Li et al. | 510/278 |

* cited by examiner

*Primary Examiner*—Charles Boyer
(74) *Attorney, Agent, or Firm*—Terry T. Moyer; Charlotte C. Wilson

(57) ABSTRACT

The present disclosure relates to compositions useful for maintaining the clean impression of a carpet (that is, its scent and appearance) over an extended time despite occurrences that might damage the carpet surface. The composition, which includes an antimicrobial agent, an enzyme inhibitor, and an odor-reacting compound, can be used by a consumer to remove contaminants from the carpet and to prevent the odor associated with the decomposition of future contamination. Specifically, the composition has been shown effective in neutralizing odors associated with the decomposition of organic materials (such as urine or food spills) by absorbing and/or removing the odor-generating source. A manufacturing treatment composition and methods for using are also disclosed.

22 Claims, No Drawings

COMPOSITION FOR REMOVAL OF ODORS AND CONTAMINANTS FROM TEXTILES AND METHOD

CROSS-REFERENCE TO RELATED APPLICATIONS

This application is a Continuation-in-Part of U.S. patent application Ser. No. 10/783,071, filed Feb. 20, 2004 now abandoned, entitled "Composition for Removal of Odors and Contaminants from Carpet and Method", which is incorporated by reference herein.

TECHNICAL FIELD

The present disclosure relates to compositions useful for maintaining the clean impression of a textile product (that is, its scent and appearance) over an extended time despite occurrences that might damage the textile surface. The composition is especially useful for textile floor covering products. The composition, which includes an antimicrobial agent, an enzyme inhibitor, and an odor-reacting compound, can be used by a consumer to remove contaminants from the textile and to prevent the odor associated with the decomposition of present and future contamination. Specifically, the composition has been shown effective in controlling odors associated with the decomposition of organic materials (such as urine or food spills) by absorbing and/or removing the odor-generating source. A pre-treatment composition and methods for using are also disclosed.

BACKGROUND

"Contamination", as defined herein, means the unintentional introduction of undesirable and potentially damaging materials onto a textile surface, specifically including contaminants such as human or animal waste, food spills, and vomit. "Textile", as used herein, refers to fibrous materials, including, without limitation, floor coverings such as carpet, area rugs, mats, and the like; upholstery and pet bed fabrics; interior fabrics, such as wall covering fabrics, bed covers, and mattress covers; and apparel fabrics, such as sportswear and undergarments. "Carpet", as used herein, refers to a textile floor covering having a plurality of pile fibers and a backing surface, and specifically includes broadloom carpeting, area rugs, and mats.

People tasked with maintaining carpet in commercial and/or residential settings have often experienced problems with removal of odors associated with organic contamination. Such contamination may occur, for example, when food or drink is spilled onto a carpet surface. Contamination also occurs if an individual or pet vomits on the carpet. Yet a third source of contamination is from human or animal urine, as may occur in homes with indoor pets or in health care or nursing facilities that care for patients suffering from incontinence.

In situations such as those described above, the contamination reaches the carpet surface and either remains on the surface or is absorbed by the pile fibers. The contaminant, which may or may not have foul odors inherent in the contaminant, will begin to decompose over time, if not removed. The decomposition process, in most instances, generates odor molecules as the organic contaminant breaks down. Clearly, this odor generation is problematic for maintaining an odor-free environment having a healthy indoor air quality. Urine odors, for example, are particularly difficult to mask or neutralize.

There are several approaches used by those tasked with maintaining clean-appearing carpet. One approach is to clean the affected area with water and/or detergent. Another approach is to clean the affected area and then apply a fragrance-carrying compound to the surface or the air to mask the odor. These approaches have not been wholly sufficient or successful.

One reason that these approaches fail is that the cleaning technique is ineffective at removing the contaminant. Because the cleaning technique is ineffective at removing all of the contaminant, some source material remains in the carpet. As this source material decomposes, odor molecules emanate from the source, resulting in an undesirable situation for those in proximity to the contamination. Furthermore, the cleaning process leaves a residual amount of cleaning compositions in the carpet. Conventional wisdom holds that any remaining detergent or surfactant left in the carpet pile will "attract" dirt, resulting in a dirty or dingy-looking appearance over time.

A second reason that these approaches fail is because, rather than eliminating odors, they only mask the odors with fragrance. When an individual has completed his cleaning efforts, he may choose to use a scented powder or spray to restore the fresh scent of the carpet. Fragrances associated with scented powders or sprays provide temporary pleasant smells to the room in which they are used, but the malodors are again noticeable when the fragrance disperses. One common and widely recognized problem with scented powders or sprays is that their high fragrance or perfume content may aggravate the allergies of some users. Perfumes can also adversely affect indoor air quality. Therefore, the use of a perfume or fragrance alone to provide a freshening impression does not solve the odor problem, and add to problems for sensitive users who are exposed to ingredients in the product that are likely to cause an allergic reaction.

Finally, using hot water or steam extraction to clean the carpet raises several issues. One issue is the availability, efficiency, and expense of the cleaning equipment. In some instances, individuals turn to professional cleaning services to perform this type of carpet maintenance. Another issue is the amount of water that is in contact with the carpet and how long it takes to dry. Water can seep through the carpet pile and into the carpet padding and/or sub-flooring, which then becomes susceptible to damage from mildew. Deterioration of the padding and sub-flooring can also be an issue. Hot water or steam extraction also leaves residual amounts of detergent or surfactant in the carpet pile, leading to problems that have been previously discussed.

The present disclosure addresses the shortcomings of the previous approaches. The present composition provides a cleaning composition that allows the contaminant to be removed before it breaks down and generates odor. The residual amount of composition that remains after cleaning is useful in preventing deterioration of future contaminants that contact the carpet and in aiding removal of future contaminants.

SUMMARY

The cleaning composition described herein includes (a) an antimicrobial agent, (b) an enzyme inhibitor, and (c) a perfume-free compound that reacts with odorous amines and thiol compounds, thereby reducing or eliminating the resulting foul odors (hereinafter referred to as an "odor-reacting compound"). The present composition is applied as a liquid, preferably in conjunction with a powder cleaning composition. More preferably, the pile of the carpet has also been treated during the manufacturing process with a treatment composition comprising an antimicrobial agent, an enzyme inhibitor, and, optionally, an odor-absorbing compound. Most preferably, the carpet to which the composition is applied has a liquid barrier layer between the pile and the backing.

DETAILED DESCRIPTION

The cleaning composition is used to maintain the fresh appearance and scent of clean carpet or other textile products. The composition is preferably used on a periodic frequency, such as once a month or, more preferably, once every two weeks, to prevent the generation of odor from decomposition of organic contaminants by enzymes in the environment. The cleaning composition can be used in a spray, in a carpet shampoo, as a liquid charge to a powder cleaning composition, and as a cleaning solution for water or steam extracting equipment.

The treatment composition used in manufacturing the carpet is preferably applied to the pile layer of the carpet, by application techniques such as impregnation, coating, foam coating, spraying, or the like. The treatment composition could also be incorporated in the barrier layer or backing layer of the carpet. The treatment composition includes an antimicrobial agent, an enzyme inhibitor, and, optionally, an odor-absorbing compound and/or an odor-reacting compound.

In one spray embodiment of the cleaning composition, an exemplary relative proportion of components is as follows:

(a) from between 0.01% to about 10% by weight of an antimicrobial agent;

(b) from between 0.01% to about 10% by weight of an enzyme inhibitor;

(c) from between 0.01% to about 10% by weight of odor-reacting compound; and (d) the percentage by weight of water is such that the total is 100%.

In one powder-like embodiment of the cleaning composition, an exemplary relative proportion of components is as follows:

(a) from between 0.01% to about 10% by weight of an antimicrobial agent;

(b) from between 0.01% to about 10% by weight of an enzyme inhibitor;

(c) from between 0% to about 10% by weight of odor-reacting compound;

(d) from between 0% to about 7% by weight of an aldehyde-containing aroma;

(e) from between 10% to about 50% by weight of water; and (f) the percentage by weight of powder is such that the total is 100%.

It should also be noted that some compounds as are useful herein may perform dual functions. For example, some antimicrobial agents (such as 2-bromo-2-nitro-1,3propanediol) also act as enzyme inhibitors. Likewise, some odor-absorbing compounds (such as zinc ricinoleate) also act as enzyme inhibitors. It should also be noted that, although one compound may perform two functions, a synergistic effect is observed from the use of different compounds and, therefore, at least two different compounds are preferably used as the antimicrobial agent and the enzyme inhibitor.

Antimicrobial Agents

The cleaning composition and the treatment composition contain an antimicrobial agent. The antimicrobial agent mainly acts as a preservative to prevent the cleaning composition from spoiling. The antimicrobial agent can also allow the contaminant to be removed (for example, during regular cleaning or maintenance) before the contaminant decomposes and generates odor. The antimicrobial component includes any organic or inorganic compound that effectively controls or inhibits the growth of odor-causing microorganisms, such as bacteria and fungus. Examples of such materials include silver zirconium phosphate, zinc oxide, imidazolidinyl urea, cationic quaternary ammonium salt, sodium sorbate, potassium sorbate, sorbic acid, grapefruit seed extract, and polyhexamethylene biguanide. Certain alcohols, such as benzyl alcohol, ethyl alcohol, n-propyl alcohol, isopropyl alcohol, and amyl alcohols, also are useful for this purpose.

Preferably, the antimicrobial agent is a formaldehyde-donor antimicrobial, such as N,N'-dimethylol 5,5-dimethyl hydantoin or N-methylol 5,5-dimethyl hydantoin. Aldehyde-based antimicrobial agents, such as glutaraldehyde, may also be used. It has been found that aldehyde-donor antimicrobials are most effective at eliminating microbes and preventing contaminant decomposition that leads to unpleasant odors, especially those odors associated with urine decomposition. It is believed that the aldehyde functionality of this class of antimicrobial agents reacts with amines and thiols of the odor source to form imine and thioacetal, respectively.

Formaldehyde-donor and aldehyde-containing antimicrobial compounds, therefore, can provide odor-controlling and odor-reducing properties in addition to preservation of the composition. When formaldehyde-donating antimicrobial compounds are used, it is preferable to minimize the free formaldehyde level to prevent potential irritation effects. The type of antimicrobial agent and the usage level should be chosen such that the free formaldehyde content in the final composition is less than 50 ppm, and preferably less than 5 ppm.

Salts of transitional metals (e.g., zinc, copper, and silver) are also effective as antimicrobial agents, but are less preferred because of their potential to adversely affect the carpet color and their deleterious environmental effects.

Enzyme Inhibitors

The cleaning composition and the treatment composition also include an enzyme inhibitor, typically present at no more than about 1% by weight of the cleaning composition. Enzyme inhibitors, such as urease inhibitors useful for controlling odorous ammonia generation from urine contamination due to urease-catalyzed decomposition of urea in human and animal urines, are desirable. Enzyme inhibitors include organic and inorganic salts of zinc, copper, zirconium, aluminum, silver, and tin, as well as organic compounds such as certain aldehydes (e.g., p-hydroxybenzyl aldehyde) and quaternary ammonium compounds.

Although there are many urease inhibitors reported, many of them either do not provide adequate urease-inhibiting performance on carpet or they discolor the textile material. For example, violuric acid is effective in inhibiting urease when incorporated in the present composition. However, because it discolors carpet and other textile materials, it would not be suitable for use herein. Acetohydroxamic acid is a well-known urease inhibitor in the biological field, but it failed to exhibit urease-inhibiting properties when tested on carpet as part of the present compositions.

Suitable non-discoloring urease inhibitors include (a) salts or complexes containing silver ions, zinc ions, or copper ions; (b) the acid and salt forms of boric acid, citric acid, sorbic acid, salicylic acid, and acetylsalicylic acid; (c) aldehydes, such as glutaraldehyde, p-hydroxybenzaldehyde, phthalic dicarboxaldehyde, and benzaldehyde; (d) bromo-nitro organic compounds, such as 2-bromo-2-nitro-1,3-propanediol; (e) phosphoamide compounds, such as phenyl phosphorodiamidate (PPDA); and (f) quinones, such as hydroquinone. At concentrations of greater than 1% by weight, phenyl phosphorodiamidate and hydroquinone discolor most carpet substrates; however, these compounds are effective urease inhibitors at concentrations of 0.1% or less.

Because of concern over the potential toxicity and environmental effect of transitional metal salts, bromo-nitro compounds and organic acid compounds are preferably used as enzyme inhibitors. Specifically, 2-bromo-2-nitro-1,3-propanediol, sodium sorbate, and p-hydroxybenzaldehyde are preferred due to their effectiveness, low toxicity, and non-discoloring properties.

Odor-Reacting Compounds

Odor-reacting compounds are an important feature of the compositions described herein. Ammonia, amines, and thiol compounds are common odorants found in urine, vomit, and other organic contaminants. Odor-reacting compounds are those that are capable of chemically reacting with one or more of these odorants, thereby reducing or eliminating these odors. Preferably, odor-reacting compounds are selected from those compounds that do not inherently have strong odors or aromas and those that are not used as perfumes, fragrances, or aromas. Odor-reacting compounds suitable for use in the liquid or powder compositions described herein include aldehyde compounds, formaldehyde-donating compounds, ketones, and oxidizing agents.

Aldehyde compounds can react with odorous amine compounds to form an imine structure. Aldehyde compounds can also react with thiol compounds to form a thioacetal structure. Formaldehyde-donor compounds, which have similar reactivity with amines and thiols, can be used in combination or interchangeably with aldehyde compounds. The reaction of odorous amines and thiols with either the aldehyde compound or the formaldehyde-donor compound results in the products of imine and thioacetal, both of which are larger molecules than their odorous substituents. As such, these resulting structures are less volatile than their predecessors and have little to no smell.

Examples of suitable aldehyde compounds include benzyl aldehyde, formaldehyde, p-hydroxybenzaldehyde, glyoxal, glutaraldehyde, formylbutanoic acid, formylcyclopentane, phenylacetaldehyde, octanal, m-tolualdehyde, o-tolualdehyde, p-tolualdehyde, salicylaldehyde, and isobutyraldehyde.

Examples of suitable formaldehyde-donor compounds include methylol acrylamide, N,N-dimethylol-5,5-dimethylhydantoin, N-methylol derivatives of amino acids, trihydroxymethyl melamine, and dimethylol dihydroxyethylene urea.

Ketones react with odorous amines to form enamines and with thiols to form thioacetals. Examples of ketones include 3,3-dimethyl-2-butanone, 2-heptanone, 5-methyl-2-hexanone, 2-octanone, diacetone alcohol, diethylketone, dipropylketone, diisobutylketone, isophorone, 2-3 butanedione, 2,5-hexanedione, benzophenone, hydroxybenzophenones, phenylacetone, phenyl ethylketones, 1,4-cyclohexanedione, and acetylacetone.

Oxidizing agents are those that are capable of oxidizing amines to amine oxide and thiols to a sulfur salt such as sulfate, thiosulfate, and the like. When using an oxidizing agent in the present composition, care must be taken to ensure that the oxidizing agent is compatible with the antimicrobial agent and the enzyme inhibitor and that it is used at suitably low concentrations. Otherwise, discoloration and/or a reaction between components may occur, adversely affecting the substrate to be cleaned or the efficacy of the cleaning composition.

Examples of oxidizing agents are hydrogen peroxide; non-transitional metal salts of perborate, percarbonate, persulfate, perophosphorate, peroxyacetic acid, and their salts; m-chloroperoxybenoic acid; dibenzoyl peroxide; chloramines; bromamines; chlorine oxide; and hypochloride compounds. By way of example, if hydrogen peroxide is used as the oxidizing agent, the active hydrogen content of the solution should be less than 2% by weight and, more preferably, less than 0.5% by weight.

Odor-Absorbing Compounds

An odor-absorbing compound may be included in the treatment composition. The odor-absorbing compound is selected from activated carbon, zeolites, zinc oxide, cyclodextrin, and zinc ricinoleate. The preferred odor-absorbing compounds are zinc ricinoleate and cyclodextrin.

Application of Composition During Manufacturing

In the treatment composition, the antimicrobial agent, the enzyme inhibitor, the optional odor-reacting compound, and the odor-absorbing compound are prepared for application to the carpet by combining the components with an amount of water appropriate for the application method. The treatment composition may be applied onto the carpet surface by spraying, by coating, by foam coating, by impregnation or the like. In cases where the treatment composition is applied as a foam, a foam stabilizing agent may also be used. The treatment composition can be applied to a carpet as part of the finishing process at the manufacturing location or as a post-treatment after the carpet has been installed.

Preferably, the treatment composition is applied to a textile during manufacturing, where an elevated temperature in the range of 60° C. to about 220° C. is used to remove water and provide durable bonding to, and penetration of, the carpet structure. The treatment composition is applied to a textile (particularly a carpet or an upholstery fabric) at an add-on level of about 5 oz/yd$^2$ to about 100 oz/yd$^2$, depending on the weight and construction of the textile material, such that the treated textile will exhibit durable antimicrobial and urease inhibiting properties without noticeable discoloration. It is believed that antimicrobial and enzyme-inhibiting properties are inherent to the finished carpet, because of the incorporation of these components into the fibers and/or the backing of the carpet.

Optionally, but preferably, a resin binder and a cross-linking agent may be further included in the composition to provide more durability. The optional odor-reacting compounds should be chosen such that the composition will not cause adverse discoloration, when applied at the elevated temperatures mentioned above.

Application of Composition During Spot or Routine Cleaning

The cleaning composition, as used by persons tasked with carpet cleaning and/or maintenance, can be sprayed directly onto the carpet surface in a concentrated form. This method of use is particularly desirable when the contaminants have created a stubborn stain. In this instance, the concentrated cleaning composition is applied to the area of the stain. The composition is allowed to penetrate the stain before being removed by blotting with an absorbent material (such as a paper towel or towel).

Alternatively, where cleaning of a larger area is necessary or desired, the composition can be applied across the surface of the carpet. In this instance, the user may prefer to employ the cleaning composition as part of a water- or steam-extraction process. The cleaning composition is then applied to the carpeting. After a few minutes, an extraction machine is used to remove the majority of the composition from the carpet.

Whereas residual amounts of conventional surfactant-based cleaners tend to attract dirt that is subsequently applied, causing stains and odors to seemingly reappear, an opposite effect is observed with the present cleaning composition. Residual amounts of the present cleaning composition have been found to aid in maintaining the fresh appearance of the carpet. It is believed that this phenomenon results from the tendency of the antimicrobial and the enzyme inhibitor to actually prevent the decay of contaminants (especially the chemical break-down of urea). By preserving the contaminants until they can be removed with a subsequent routine cleaning, the present composition prevents their decomposition and the foul odors associated with decomposition.

Alternatively, and perhaps more preferred, a smaller, but more concentrated, amount of liquid cleaning composition is charged onto a powder composition (that is, sprayed onto the powder composition until the powder composition is damp). One particularly suitable powder composition for this purpose is described in U.S. Pat. No. 4,434,067 to Malone, assigned to Milliken Research Corporation and incorporated herein by reference.

The preferred, patented powder composition contains an absorbent and/or adsorbent particulate polymeric material, an inorganic salt adjuvant, and an aqueous or organic fluid component. The powder-like cleaning composition has liquid absorbing properties and the ability to adhere to dirt and contaminant particles.

Specifically, the powdered cleaning composition is provided consisting essentially of:

(a) about 100 parts by weight particulate polymeric material having an average particle size of from about 37 to about 105 microns in diameter, an oil absorption value of no less than about 90, and a bulk density of at least about 0.2 g/cc;

(b) from about 5 to about 400 parts by weight of an inorganic salt adjuvant having an average particle size of from about 45 to about 60 microns in diameter; and (c) from about 5 to about 400 parts by weight of a fluid consisting essentially of 0 to 100 percent water containing sufficient surfactant to give a surface tension of less than about 40 dynes per centimeter and 100 to 0 percent of organic liquid selected from high boiling hydrocarbon solvents, tetrachloroethylene, methylchloroform, 1,1,2-trichloro-1,2,2-trifluoroethane, an aliphatic alcohol containing from 1 to about 4 carbon atoms, and mixtures thereof.

It has been found that this particular compound is highly effective at removing a variety of contaminants from carpet, without creating any of the problems associated with wet cleaning techniques in which the carpet is saturated.

In use, the powder-like composition (as described above to which the present liquid composition is incorporated) is applied to a textile substrate, by hand or by using a sieve-like material. Typically, between 0.1 inches and 1.0 inches of powder-like material is used to cover the contaminated area. A brush is then used to rub the powder-like material into the carpet (or other textile material, such as upholstery fabric) to allow the powder-like material to absorb and adhere to contaminants. The powder-like material is then removed by vacuuming the area, usually between one and two hours after the application of the powder.

When the powder-like cleaning composition is removed by vacuuming, the contaminants (and their associated odors) are also removed. Because the majority of the composition does not remain on the textile article being cleaned, odor-reacting compounds are not necessary, although preferred, to provide odor-removing performance. Antimicrobial and non-discoloring enzyme inhibitors, and optionally odor-absorbing compounds and aldehyde aroma compounds, are suitable for incorporation in the powder-like cleaning composition described above. Further, the residual amounts of the powder-like cleaning composition to which an antimicrobial and an enzyme inhibitor have been added provide the same benefits as were described above in preventing the decay (and subsequent odor generation) of contaminants.

Other Additives

An aldehyde-containing aroma is preferred as an optional fragrance component in the powder-like cleaning composition, when a certain aroma characteristic is desired. Examples of preferred fragrances include citral, cinnamic aldehyde, hexyl cinnamic aldehyde, benzyl aldehyde, benzyl salicylate, amyl cinnamic aldehyde, and vanillin. The most preferred of these is hexyl cinnamic aldehyde, which is commonly used to create a "fresh" scent in many consumer products, such as fabric softeners.

Also optionally included in either the aqueous or powder-like cleaning composition are surfactants that enhance cleaning properties. Useful surfactants are ones that do not discolor the carpet, but that provide emulsifying properties for the other components in the cleaning composition.

It is also preferred that the final pH of the cleaning composition (whether liquid or powder-like form) is less than 8 and, more preferably, in the range of 3 to 7. pH values of higher than 8 can cause potential discoloration of some of the components in the composition, and particularly discoloration of the carpet. Low pH values (that is, less than 3) are corrosive to many metals and are potential skin irritants. Acids, such as citric acid, acetic acid, oxalic acid, formic acid, sulfuric acid, phosphoric acid, and nitric acid, can be used to adjust the final pH of the composition.

Even though the compositions disclosed herein are effective in cleaning and controlling malodors on textile materials, it is also contemplated that these compositions may be used for cleaning and controlling odors on hard surfaces, such as vinyl, ceramic tile, concrete, hardwood, and laminated composites surfaces.

The following examples, and testing thereof, are intended to be representative of various embodiments of the present invention.

TESTING OF EXEMPLARY EMBODIMENTS

The following tests were conducted to demonstrate the effectiveness of the present cleaning composition at controlling human urine odor.

Test 1: Odor Prevention Test

The test procedure is described as follows. For each sample, 40 ml of fresh human urine was applied to the carpet pile that had been cleaned with a cleaning composition. Each sample was sealed inside a 2 mil thick plastic bag to prevent evaporation of moisture and odors. The samples were stored inside the sealed bags for ten days, after which human judges were asked to evaluate, on a scale of 1 to 10, the odor in the headspace of the bag. Using this scale, 1 indicated the worst odor and 10 indicated the most pleasant odor.

After being assessed by the judges, the carpet samples were removed from the bags and cleaned with the same cleaning composition. Another 40 mL of fresh human urine was applied to each carpet sample. Each sample was then placed in a clean 2 mil thick plastic bag, where the sample remained for a total of 5 days. At the end of the 5 days, the human judges again evaluated the odor in the headspace of the bags using the same 1 to 10 scale. The pH of the headspace was also evaluated, using a pH indicator strip moist with distilled water, to detect the presence of ammonia (pH values higher than 7 indicate the presence of ammonia).

Test 2: Odor Removal Test

In this experiment, human urine was collected and stored for 10 days in a sealed bottle. Strong ammonia and other odors developed. 10 mL of the aged urine was applied to an 8"×8" carpet sample, and the carpet was allowed to sit for 2 hours before being cleaned with the present liquid cleaning composition as used with the powder cleaning composition described herein. The powder cleaning composition was dampened with the present liquid cleaning composition and then sprinkled onto the carpet. The cleaning composition was brushed into the carpet and then removed by vacuuming.

The odor of the carpet sample was evaluated following cleaning and two weeks after cleaning to determine whether the cleaning composition was effective at removing odor. No ammonia or other offensive odors were detected at either time.

Having been evaluated, the recently cleaned sample was subjected to another round of testing, in which an additional 10 mL of human urine were added to the carpet. The carpet sample was then placed into a sealed plastic bag to prevent evaporation of the moisture and dispersion of any generated odors.

After ten days storage at room temperature, the sample was evaluated to determine whether the residual cleaning composition remaining in the carpet was effective at preventing the generation of odors from later-applied contaminants. No ammonia or other odors were detected, proving that the cleaning composition was effective in preventing the generation of odors.

EXAMPLE 1

Manufacturing Treatment Composition

This example was created as a comparative example for the compositions described in EXAMPLES 2 and 3. In this composition, the antimicrobial component was purposely omitted. The comparative treatment composition comprised:

(a) as an odor-absorbing agent (and also as enzyme inhibitor), 3% by weight of zinc ricinoleate, available as 30% active ingredient from Degussa sold under the trade name "TEGO SORB 30";

(b) as an pH adjuster, 0.3% by weight of citric acid;

(c) as solvent, water such that the total percentage equaled 100%.

EXAMPLE 2

Manufacturing Treatment Composition

This example describes a first embodiment of a treatment composition useful for application to the carpet surface during manufacturing or after installation. The treatment composition comprises:

(a) as antimicrobial compound (and also an enzyme inhibitor), 2-bromo-2-nitro-1,3propanedial;

(b) as a pH adjuster, 0.3% by weight of citric acid;

(c) as solvent, water such that the total percentage equaled 100%.

EXAMPLE 3

Manufacturing Treatment Composition

This example describes a second embodiment of a treatment composition useful for application to the carpet surface during manufacturing or after installation. The treatment composition comprises:

(a) as an enzyme inhibitor, 0.02% by weight of 2-bromo-2-nitro-1,3propanediol;

(b) as an odor-reacting compound and preservative, 0.5% by weight of monomethylol dimethyl hydantoin, a formaldehyde-donor antimicrobial agent sold as a 55% active solution under the trade name "DANTOGARD 2000" by Lonza Corporation of Fair Lawn, N.J.;

(c) as a pH adjuster, 0.3% by weight of citric acid; and (d) as solvent, water such that the total percentage equaled 100%.

EVALUATION OF EXAMPLES 1, 2, and 3

20 mL of EXAMPLES 1, 2, and 3 were allowed to soak into 4"×4" square carpet samples. The carpet samples were dried at about 110° C. for 20 minutes to evaporate the water, leaving (on EXAMPLES 2 and 3) a thin coating of antimicrobial compound and enzyme inhibitor on the yarns and base of the carpet pile. Other trials in which samples were dried at about 300° F. and at about 370° F. showed decreased efficacy, but the samples were still functional.

When tested using Test 1, as described above, the three carpet treatments prevented the generation of detectable amounts of ammonia.

When tested using Test 2, only EXAMPLES 2 and 3 were successful at preventing the generation of odor for one month, thus supporting the hypothesis that the combination of an antimicrobial component and an enzyme-inhibiting component is most effective.

Further, five cycles of cold water extraction were performed on Example 3, using a commercially available carpet extractor. The odor-control performance did not change noticeably after the extractions, thereby indicating the durable nature of the treatments achieved by penetration of the treatment solution into the carpet and bonding of the components to the carpet.

EXAMPLE 4

Liquid Cleaning Composition

One embodiment of the liquid cleaning composition was created comprising the following ingredients:

(a) as an antimicrobial agent, 0.5% by weight of monomethylol dimethyl hydantoin, a formaldehyde-donor antimicrobial solution sold as a 55% active aqueous solution under the trade name "DANTOGARD 2000" by Lonza Corporation of Fair Lawn, N.J.;

(b) as a urease inhibitor and preservative, 1% by weight of sodium sorbate (formed by mixing equivalent amounts of sorbic acid and sodium hydroxide solution);

(c) as a urease inhibitor, 0.1% by weight of hydroquinone;

(d) as an odor-reacting compound, 0.2% by weight of p-hydroxybenzaldehyde;

(e) as a pH-adjuster, 0.2% by weight of citric acid, to adjust the pH of the solution to about 6; and (f) as solvent, water such that the total percentage by weight equaled 100%.

Test 3: Urease Inhibition Test

The ingredients were combined and used to saturate a 2" circle of carpet. The carpet was then blotted dry with paper towel such that the carpet circle retained about one gram of the solution. Then, 4 milliliters (mL) of 10% urea and 3 drops of 0.005% urease (type III, purchased from Sigma) were added separately to the treated carpet and to an untreated "control" carpet. Urease is an enzyme that causes urea to decompose and release ammonia, which is responsible for the characteristic pungent smell of urine odor.

Each carpet samples was sealed in a 250 mL plastic beaker. A small piece of nonwoven fabric impregnated with bromothymol blue indicator water solution was then used to monitor the presence of ammonia in the headspace of each beaker. This indicator solution is light yellow in the absence of ammonia, but turns to dark blue in the presence of ammonia.

Observations were made 1 hour, 2 hours, and 4 hours after the addition of the urea and urease solutions. After approximately only 10 minutes, the control carpet sample (untreated) showed the presence of ammonia. At no time during the observation period did the treated sample indicate the presence of ammonia. This result indicates that the chemical cleaning compound described above is capable of inhibiting urease activity and preventing ammonia generation from the decomposition of urea.

Also worth noting, the untreated control sample generated significant ammonia odor in the headspace of the beaker after 2 hours.

In comparison, commercially available products, such as Febreeze (from Proctor & Gamble of Cincinnati, Ohio); Syon 5 (from Collins & Aikman Floorcoverings of Dalton, Ga.); and Woolite Pet Stain & Upholstery Cleaner (from Platex, Inc.?), mask the odor of ammonia, but the presence of ammonia is detectable by this method after less than half an hour on average.

EXAMPLE 5

Liquid Cleaning Composition

An alternate embodiment of the liquid cleaning composition was created comprising the following ingredients:

(a) as an antimicrobial agent and enzyme inhibitor, 3% by weight of sodium sorbate;

(b) as an antimcrobial agent, 0.5% by weight of monomethylol dimethyl hydantoin, a formaldehyde-donor antimicrobial solution sold as a 55% active aqueous solution under the trade name "DANTOGARD 2000" by Lonza Corporation of Fair Lawn, N.J.;

(c) as a pH adjustment, 0.3% by weight of citric acid;

(d) as an odor-reacting compound, 0.1% by weight of N,N'-dimethylol 5,5-dimethylhydantoin;

(e) as an odor-absorbing agent (and also as enzyme inhibitor), 3% by weight of zinc ricinoleate, available as 30% active ingredient from Degussa sold under the trade name "TEGO SORB 30"; and (f) as solvent, water such that the total percentage equaled 100%.

The addition of zinc ricinoleate was found to be effective at absorbing some of the odor associated with urine as a contaminant.

EXAMPLE 6

Liquid Cleaning Composition

Yet another embodiment of the liquid cleaning composition was created comprising the following ingredients:

(a) as an antimicrobial agent and urease inhibitor, 1% by weight of sodium sorbate;

(b) as an enzyme inhibitor, 0.05% by weight of 2-bromo-2-nitro-1,3-propanediol;

(c) as an odor-reacting compound, 0.2% by weight of N,N'-dimethylol-5,5-dimethylhydantoin;

(d) as a pH adjuster, 0.3% by weight of citric acid, such that the pH of the solution was about 6;

(e) as surfactants to aid in suspending the components in solution and to aid in cleaning, 1% by weight of "Tween 40" sold by Uniqema of New Castle, N.J., and 1% by weight of "Pluronic L62LF" sold by BASF Corporation; and (f) as solvent, water such that the total percentage equaled 100%.

This composition completely prevented the generation of detectable ammonia odors when tested according to Test 1 and Test 2. The composition also inhibited ammonia generation in the Urease Inhibition Test.

EXAMPLE 7

Powder-Like Cleaning Composition

A liquid cleaning composition was created similar to that of EXAMPLE 5, which was added to a urea formaldehyde resin powder having 30% moisture content, thereby creating a damp powder-like cleaning composition comprising the following ingredients:

(a) as an antimicrobial agent and a urease inhibitor, 3% by weight of sodium sorbate;

(b) as an antimicrobial agent, 0.5% of monomethylol dimethyl hydantoin, a formaldehyde-donor antimicrobial agent sold as a 55% active aqueous solution under the trade name "DANTOGARD 2000" by Lonza Corporation of Fair Lawn, N.J.;

(c) as a pH adjustment, 0.3% of citric acid;

(d) as an odor-absorbing agent (and also as enzyme inhibitor), 3% by weight of zinc ricinoleate, available as 30% active ingredient from Degussa sold under the trade name "TEGO SORB 30";

(e) as an odor-reacting aroma compound, 1% by weight of hexyl cinnamic aldehyde, 1% by weight of a fragrance blend sold as "Green Downy-type Fragrance H20-type" from Berge';

(f) 5% by weight of water; and (g) as carrier, urea formaldehyde resin powder such that the total percentage equaled 100%.

Examples 4 through 7 are effective in urease inhibition and odor prevention when tested using Test 1.

Comparative Test

Three carpet samples, having been cleaned using different methods, were used in this test. All of the samples were 15"×15" carpet squares, constructed with a liquid barrier layer between the pile face yarns and the foam backing and a silver zirconium phosphate antimicrobial agent in the back-coating.

Test Sample A was cleaned using the composition of Examples 5 and 7 described above. The carpet was sprayed with in a fine mist of the composition of Example 5. The powder composition of Example 7 was then brushed into the carpet. Then, the carpet was vacuumed, using a commercially available vacuum cleaner.

Test Sample B was cleaned using a commercially available liquid cleaning solution for carpet, which includes as its active ingredient an Australian tea tree extract. The carpet was saturated with the cleaning solution and then subjected to cleaning with an extraction-type vacuum cleaner.

Test Sample C was cleaned using only water with an extraction-type vacuum cleaner. No cleaning compositions were used.

The three samples were tested according to the procedure described above for Test 1. TABLE 1 shows the results of COMPARATIVE TEST.

TABLE 1

Results of COMPARATIVE TEST (Odor Prevention)

| Sample ID | Cleaning Method | Headspace pH (lower = good) | Odor Rating (higher = good) |
|---|---|---|---|
| Test Sample A | Cleaning Compositions of Examples 5 & 7 + Vaccum | 5 | 8 |
| Test Sample B | Commercially Available Cleaning Liquid + Extraction | 9 | 2 |
| Test Sample C | Water + Extraction | 10 | 1 |

The results above indicate that the present cleaning composition and composition are effective in controlling human urine odors on carpet and in preventing ammonia generation.

CONCLUSIONS

The tests conducted indicate that the compositions described herein, which comprise an antimicrobial compound and an enzyme inhibitor, are effective at removing existing contaminants and their odors from carpet, at preventing recurrence of odors from degeneration of later applied contaminants, and at maintaining the desired appearance and smell of carpet cleaned according to the teachings herein. For these reasons, the present compositions represent a useful advance over the prior art.

What is claimed is:

1. A powder-like cleaning composition, said composition consisting of:

(a) at least one antimicrobial compound;

(b) at least one enzyme inhibitor, said enzyme inhibitor being a compound different from said antimicrobial compound;

(c) urea formaldehyde resin powder; and (d) water, such that said composition is slightly damp and has a powder-like consistency; and wherein said composition is effective at maintaining the appearance and smell of a textile.

2. The powder-like cleaning composition of claim 1, wherein said antimicrobial compound is from about 0.01% to about 10% by weight of said composition; said enzyme inhibitor is from about 0.01% to about 10% by weight of said composition; said water is from about 10% to about 50% by weight of said composition; and said urea formaldehyde resin powder comprises the remainder by weight of the composition.

3. The composition of claim 1, wherein said antimicrobial compound is selected from the group consisting of silver zirconium phosphate, zinc oxide, polyhexamethylene biguanide, imidazolidinyl urea, cationic quaternary ammonium salt, sodium sorbate, potassium sorbate, sorbic acid, and grapefruit seed extract.

4. The composition of claim 1, wherein said antimicrobial compound is a formaldehyde-donor antimicrobial compound.

5. The composition of claim 4, wherein said formaldehyde-donor antimicrobial agent is selected from the group consisting of N,N'-dimethylol 5,5-dimethyl hydantoin, N-methylol 5,5-dimethyl hydantoin, and mixtures thereof.

6. The composition of claim 5, wherein said formaldehyde-donor antimicrobial agent is N-methylol 5,5-dimethyl hydantoin.

7. The composition of claim 1, wherein said enzyme inhibitor is selected from the group consisting of aldehydes, wherein said aldehydes are selected from the group consisting of glutaraldehydes, p-hydroxybenzaldehyde, phthalic dicarboxyaldehyde, and benzalclehyde; salts containing ions selected from the group consisting of silver, zinc, and copper; complexes containing ions selected from the group consisting of silver, zinc, and copper; boric acid and salts of boric acid; citric acid and salts of citric acid; sorbic acid and salts of sorbic acid; organic bromo-nitro compounds; phosphonamide compounds; and quinones.

8. The composition of claim 7, wherein said enzyme inhibitor is an organic bromo-nitro compound.

9. The composition of claim 8, wherein said bromo-nitro compound is 2-bromo-2-nitro-1,3-propanediol.

10. A powder-like cleaning composition, said composition consisting of:

(a) at least one antimicrobial compound;

(b) at least one enzyme inhibitor, said enzyme inhibitor being a compound different from said antimicrobial compound;

(c) urea formaldehyde resin powder; and (d) water, such that said composition is slightly damp and has a powder-like consistency; and wherein said composition is effective at maintaining the appearance and smell of a textile, said composition further consisting of (e) an odor-reacting compound that reacts with amine and thiol, said odor-reacting compound being present in an amount of no more than about 10% by weight of said composition.

11. The composition of claim 10, wherein said odor-reacting compound is selected from the group consisting of aldehydes, formaldehyde-donating compounds, ketones, and oxidizing agents.

12. The composition of claim 11, wherein said odor-reacting compound is an aldehyde selected from the group consisting of benzyl aldehyde, formaldehyde, p-hydroxybenzaldehyde, glyoxal, glutaraldehyde, formylbutanoic acid, formylcyclopentane, phenylacetaldehyde, octanal, m-tolualdehyde, p-tolualdehyde, o-tolualdehyde, salicylaldehyde, and isobutyraldehyde.

13. The composition of claim 11, wherein said odor-reacting compound is a formaldehyde-donor compound selected from the group consisting of N,N'-dimethylol-5,5,-dimethylhydantoin, methylol acrylamide, N-methylol derivative of amino acids, trihydroxymethyl melamine, and dimethylol dihydroxyethylene urea.

14. The composition of claim 11, wherein said odor-reacting compound is a ketone selected from the group consisting of 3,3-dimethyl-2-butanone, 2-heptanone, 5-methyl-2-hexanone, 2-octanone, diacetone alcohol, diethylketone, dipropylketone, diisobutylketone, isophorone, 2,3-butanedione, 2,5-hexanedione, benzophenone, hydroxybenzophenones, phenylacetone, phenyl ethylketones, 1,4-cyclohexanedione, and acetylacetone.

15. The composition of claim 11, wherein said odor-reacting compound is an oxidizing agent selected from the group consisting of hydrogen peroxide; non-transitional metal salts of perborate, percarbonate, persulfate, perophosphorate, peroxyacetic acid; chloroperoxybenzoic acid; dibenzoyl peroxide; chloramines; bromamines; chlorine oxide; and hypochloride compounds.

16. A powder-like cleaning composition, said composition consisting of:

(a) at least one antimicrobial compound;

(b) at least one enzyme inhibitor said enzyme inhibitor, being a compound different from said antimicrobial compound;

(c) urea formaldehyde resin powder; and (d) water, such that said composition is slightly damp and has a powder-like consistency; and wherein said composition is effective at maintaining the appearance and smell of a textile, said composition further consisting of (f) an odor-absorbing compound selected from the group consisting of activated carbon, zeolites, zinc oxide, cyclodextrin, and zinc ricinoleate.

17. The composition of claim 16, wherein said odor-absorbing compound is zinc ricinoleate.

18. The composition of claim 16, wherein said odor-absorbing compound is present in an amount of no more than about 10% by weight of said composition.

19. The composition of claim 1, wherein said composition has a pH in the range of 3 to 7.

20. A powder-like cleaning composition, said composition consisting of:

(a) at least one antimicrobial compound;

(b) at least one enzyme inhibitor, said enzyme inhibitor being a compound different from said antimicrobial compound;

(c) urea formaldehyde resin powder; and (d) water, such that said composition is slightly damp and has a powder-like consistency; and wherein said composition is effective at maintaining the appearance and smell of a textile, said composition further consisting of (g) an aldehyde-containing aroma compound selected from the group consisting of citral, cinnamic aldehyde, hexyl cinnamic aldehyde, benzyl aldehyde, benzyl salicylate, amyl cinnamic aldehyde, and vanillin.

21. The composition of claim 20, wherein said aroma compound is hexyl cinnamic aldehyde.

22. The composition of claim 20, wherein said aroma compound is present in an amount of no more than about 7% by weight of said chemical composition.

* * * * *

UNITED STATES PATENT AND TRADEMARK OFFICE

CERTIFICATE OF CORRECTION

PATENT NO. : 7,135,449 B2
APPLICATION NO. : 10/935032
DATED : November 14, 2006
INVENTOR(S) : Shulong Li and Richard A. Mayernik It is certified that error appears in the above-identified patent and that said Letters Patent is hereby corrected as shown below:

Column 14, Claim 7, Line 50 “benzalclehyde” should be --benzaldehyde--

Signed and Sealed this

Thirteenth Day of March, 2007

JON W. DUDAS
*Director of the United States Patent and Trademark Office*